US006726118B2

(12) United States Patent
Moulson

(10) Patent No.: US 6,726,118 B2
(45) Date of Patent: Apr. 27, 2004

(54) WATER FOUNTAIN SUPPORT CONTAINER

(75) Inventor: Ian Moulson, Wickford (GB)

(73) Assignee: Fiona Moulson and Ian Moulson, Essex (GB)

( * ) Notice: Subject to any disclaimer, the term of this patent is extended or adjusted under 35 U.S.C. 154(b) by 0 days.

(21) Appl. No.: 10/182,300

(22) PCT Filed: Feb. 1, 2001

(86) PCT No.: PCT/GB01/00398

§ 371 (c)(1),
(2), (4) Date: Oct. 7, 2002

(87) PCT Pub. No.: WO01/56707

PCT Pub. Date: Aug. 9, 2001

(65) Prior Publication Data

US 2003/0057292 A1 Mar. 27, 2003

(30) Foreign Application Priority Data

Feb. 1, 2000 (GB) ..... 0002272

(51) Int. Cl.[7] ..... B05B 17/08

(52) U.S. Cl. ..... 239/17; 239/16; 239/20; 239/21; 239/22; 239/23; 239/211

(58) Field of Search ..... 239/16, 17, 20–23, 239/211, 24, 289, 124, 18, 19

(56) References Cited

U.S. PATENT DOCUMENTS 776,930 A * 12/1904 Oldbridge ..... 239/17
1,651,714 A * 12/1927 Kern ..... 239/17
2,974,871 A 3/1961 Nathons ..... 239/17
3,409,223 A * 11/1968 Gosh ..... 239/12
3,419,216 A 12/1968 Angelastro et al. ..... 239/20
5,749,518 A * 5/1998 Wang ..... 239/17
6,029,899 A * 2/2000 Walker ..... 239/17

FOREIGN PATENT DOCUMENTS

DE 29514083 1/1997

* cited by examiner

*Primary Examiner*—Robin O. Evans
(74) *Attorney, Agent, or Firm*—Andrus, Sceales, Starke & Sawall, LLP

(57) ABSTRACT

A water fountain support container for creating a water feature, comprising a base (5) having a bottom wall (9) and upstanding side walls (8) which together define a liquid reservoir (10), and, a lid (6) which locates on and is supported by the base. The base is preferably circular in overall configuration and has at least two, but preferably three, inwardly-directed portions (11) which project inwardly with respect to the side wall. There is at least one aperture (16) through the lid (6). In use, liquid contained within the reservoir is circulated by a pump also located therein, the liquid being pumped through a pipe passing out through the aperture (16) and subsequently falling under gravity back onto the lid (6) and so into the reservoir (10), after passing through the aperture (16) in the lid. The inwardly-directed portions (11) support the lid (6) and allow decorative or structural elements of a significant weight to be easily and safely supported on the lid.

14 Claims, 2 Drawing Sheets

WATER FOUNTAIN SUPPORT CONTAINER

CROSS-REFERENCE TO RELATED APPLICATIONS

This application is the U.S. national stage application of International Application PCT/GB01/00398, filed Feb. 1, 2001, which international application was published on Aug. 9, 2001, as International Publication WO 01/56707 in the English language. The International Application claims priority of British Patent Application No. 00022723 filed Feb. 1, 2000.

The present invention relates to a device for use in creating water features in gardens.

There is a demand for the creation of running water displays such as fountains or cascades (herein generally referred to as water features) Within gardens or other recreational spaces. Such water features usually have some form of flowing water driven by a pump. The pump circulates the water round a particular course so as to create the appearance of a fountain or running water. To achieve an aesthetically pleasing appearance, the pump is usually located out of sight. Further, it is usually necessary to have a reservoir from which water is pumped and to which it returns under gravity. This allows a small amount of water to be constantly recycled.

Water features were previously created by complex construction, but this was simplified by the introduction of pre-formed reservoirs that can be fixed into a required place. Currently only simple bucket-shaped containers are available as reservoirs, but these have major disadvantages. Not only are they relatively small so that the area of the upper end is also small, thereby allowing only small water features to be made, but more importantly, they do not allow objects to be placed on top. In order to get round this second problem, people have placed mesh lids on the bucket, but such lids must either be formed of a strong and therefore expensive material, or otherwise they lack sufficient strength to support more than a small weight.

It is an aim of the present invention to provide a cheap and easily manufactured device that overcomes the above problems and improves on the existing technology by allowing larger and heavier water features to be constructed with simplicity. The device aims at providing both a pre-formed reservoir and a strong structural foundation for the construction of a water feature.

Therefore, according to the present invention there is provided a device for use in creating a water feature, comprising a base having a bottom wall and upstanding side walls which together define a liquid reservoir, the side walls including at least two inwardly-directed portions which project inwardly with respect to the reservoir, and a lid for the reservoir upon which lid at least a part of a water feature may be constructed, the lid locating on the inwardly-directed portions of the side walls to be supported thereby, and the lid having an aperture through which liquid contained within the reservoir may be pumped and subsequently flow back under gravity into the reservoir.

In use any liquid, usually water, contained within the reservoir is circulated by a pump which may also be contained therein. The liquid is pumped through a tube extending through the aperture in the lid and subsequently cascades under gravity back to the reservoir passing through the same or other apertures in the lid. The lid is advantageously provided with a plurality of apertures, so that water cascading thereafter may more easily pass back into the reservoir.

The lid may be contoured so that liquid falling onto the lid will flow under gravity toward the aperture or apertures.

The inwardly-directed portions are preferably provided with upper support surfaces which, possibly in combination with the outer rim of the base support the lid, and the weight of any decorative or structural elements placed on said lid. It is important that the device is able to support relatively heavy constructions, such as several large stones or a stone fountain. The inwardly-directed portions support the lid, and the weight of anything placed thereon, and reduce the length of any span (for example between adjacent inwardly-directed portions) that the lid covers.

Preferably, the base is generally circular in plan view, and has three inwardly-directed portions, each being approximately equally distributed around the generally-circular base. This allows the lid to rest securely on the base, and provides the device with a sufficient degree of strength without needing to resort to complex manufacture. The peripheral region of the lid may be adapted to locate on the upper support surfaces of the inwardly-directed portions and/or the upper edge of the side wall. The lid could be generally circular or could be configured to have a central region and three outwardly-projecting regions which extend over the reservoir between adjacent inwardly-directed portions. Such a lid, having three outwardly-projecting regions, would not need completely to cover the upper support surfaces, so these surfaces could directly support parts of a water feature constructed thereon.

Preferably, the base and the lid are formed from moulded plastics materials because such materials allow a strong yet relatively light structure to be made Furthermore, plastics materials are generally waterproof and resistant to degradation which is extremely useful in the applications envisaged for the present Invention. Advantageously the base and lid are formed by injection, vacuum or other moulding process for plastics.

By way of example only, the present invention will now be described with reference to the accompanying drawings in which.

Figure 1:
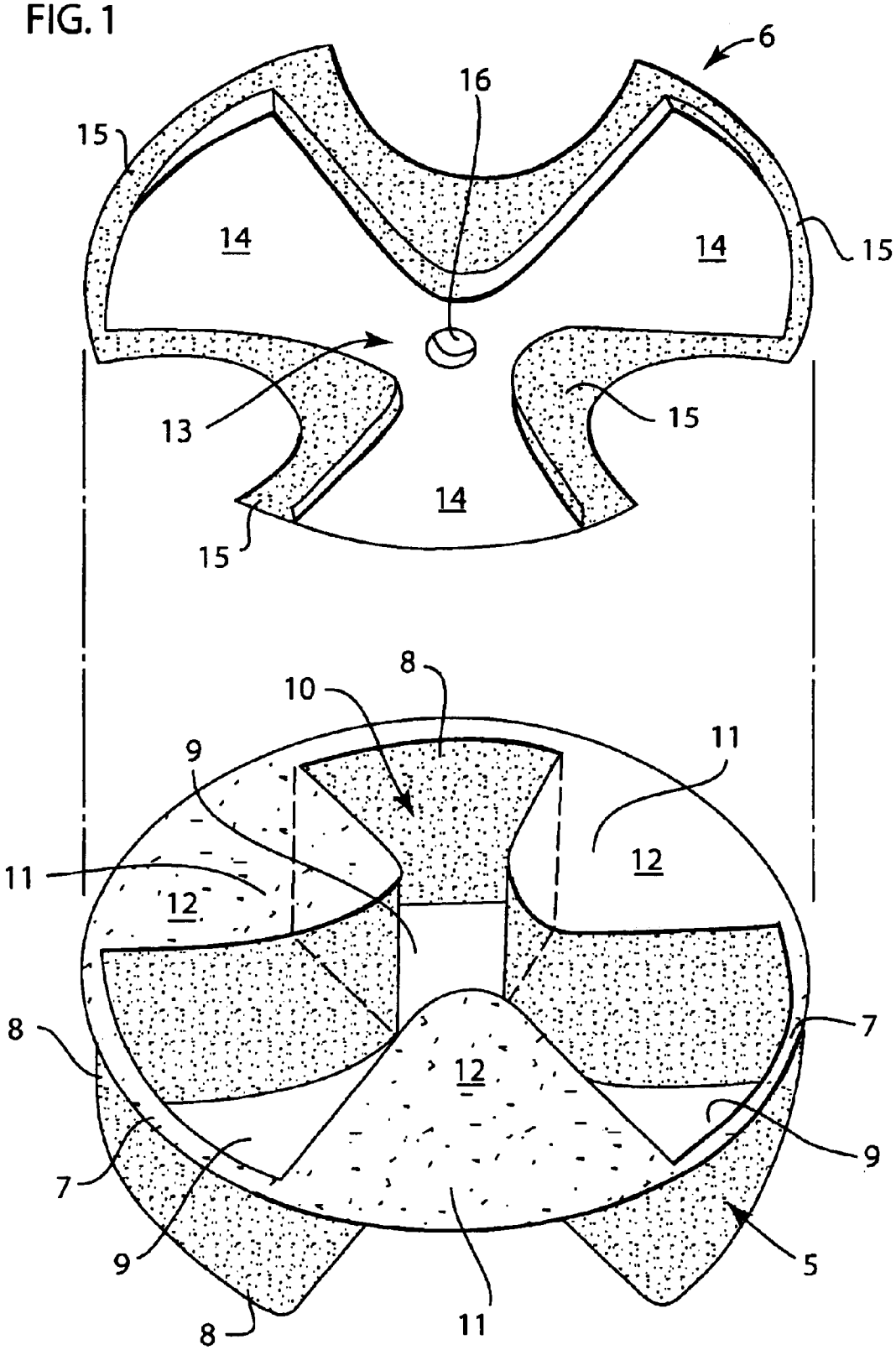
FIG. 1 is a perspective view of one embodiment of base and lid of the present invention.
Figure 2:
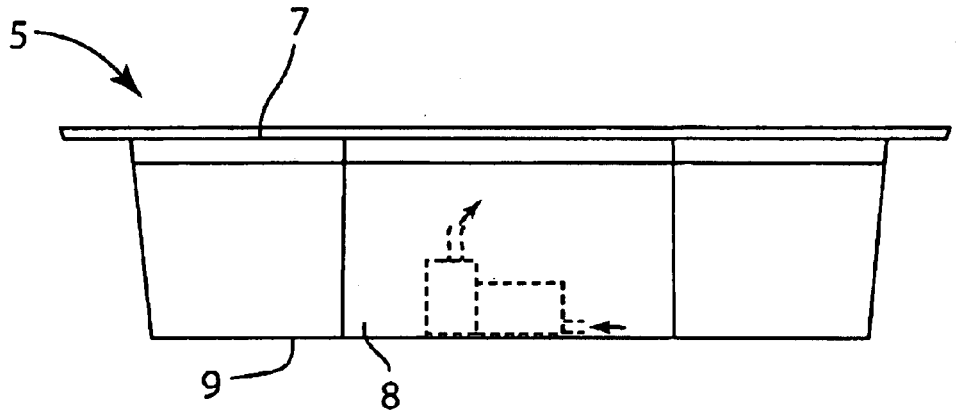
FIG. 2 is a side view of the base of FIG. 1.
Figure 3:
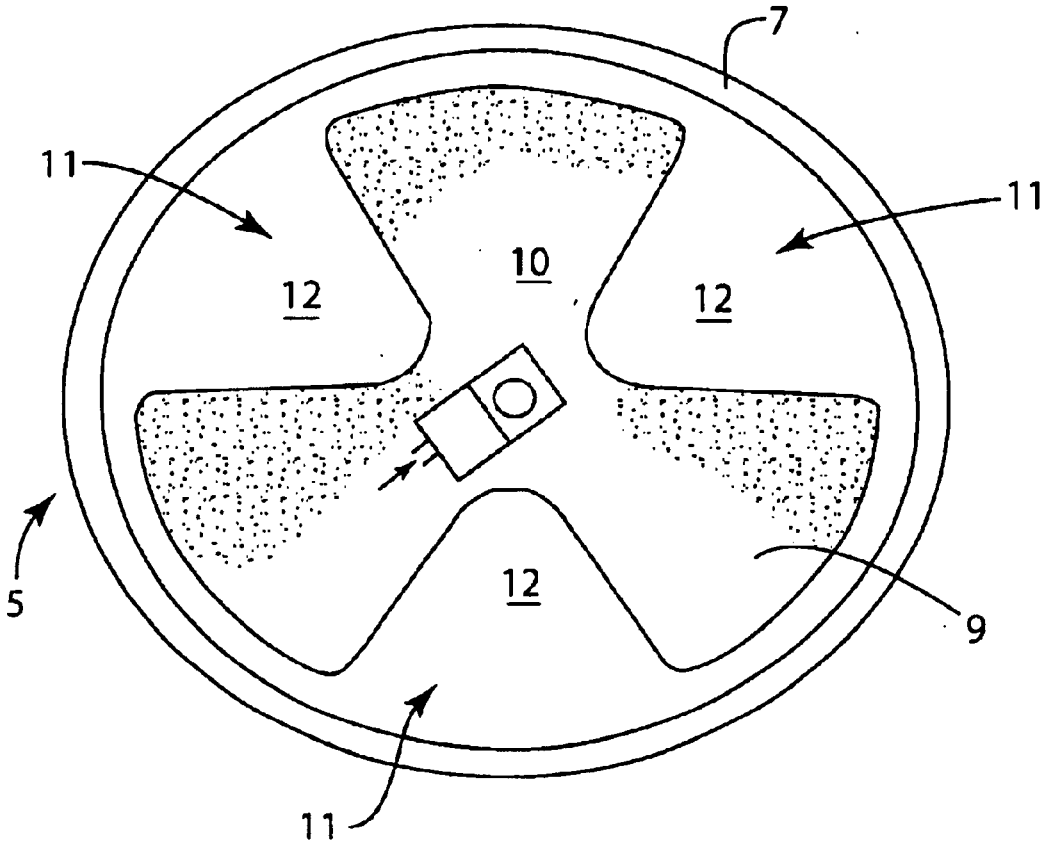
FIG. 3 is a plan view of the base.

Referring to FIGS. 1, 2 and 3, there is shown a base generally indicated 5 and a lid generally indicated 6. The base 5 has a generally circular rim 7, side walls 8 and a bottom wall 9. The side walls 8 and bottom wall 9 define a liquid reservoir 10 which in use contains water (not shown) and a pump shown in FIGS. 2 and 3 only. Three inwardly-directed portions 11 are formed by appropriate moulding of the side wall 8 and the upper surface of each is formed into a generally flat upper support surface 12 The lid 6 (shown for clarity in a slightly different perspective) is overall of a generally three-armed shape with a central region 13, three projecting edge regions 14 and a peripheral region 15. An aperture 16 is formed at in the central region 13 of the lid 6, which aperture 16 allows the passage of a water pipe (not shown) from the pump (located in the reservoir, and shown in FIGS. 2 and 3) being created on the embodiment of the present invention. The aperture, if it is the only one, also allows the return of water to the reservoir.

In use, the lid 6 is placed upon the base 5 and the peripheral region 15 bears upon and is supported by the upper support surfaces 12 of the inwardly-directed portions 11 and regions of the rim 7. The lid is contoured so that the areas of the lid other than the peripheral region 15 (i.e. the central region 13 and the projecting edge regions 14) are in a lower plane than the peripheral region so that water falling on the lid or upper support surfaces 12 is channelled toward the aperture, whereby the water may return to the reservoir. This contouring also helps to ensure the correct positioning of the lid relative to the base. The aperture is large enough to allow the passage of a pipe from the pump whilst permitting water to flow back through the remaining space.

In use, the base may be placed in a hole formed in the ground, and the rim 7 thereof aligned approximately with the surface of the ground. For example a hole of sufficient size may be dug to accommodate the base, with the base being located therein. The gaps around the base are filled in with earth, concrete or the like, once suitable power and other supplies are provided. A pump (usually electric) is connected to the power supply and a sufficient amount of water is introduced into the reservoir. The pump has a outflow pipe which extends upwards. The lid 6 is placed on the base 5 and is supported by the upper support surfaces 12 of the inwardly-directed projections 11. An appropriate decorative feature such as a pile of stones is then constructed on the lid. The outflow pipe passes through the aperture 16 to a point at the top of the stones where the water is released, the pipe being concealed above the lid by the constructed water feature The pumped water then flows under gravity back over the rocks and Into the reservoir 10 through the aperture 16, for re-circulation by the pump.

Alternatively, the base may be placed on the surface of the ground and the water feature built thereon. This would allow the water feature to be built on concrete and other solid surfaces. The base and lid are strong enough to support such a freestanding water feature. In such a case decorative cladding may be constructed around the side wall, to conceal the base.

A water feature created on top of the embodiment of the present invention may be extremely heavy when compared to those constructed on devices according to the prior art. This is because the present invention has a significantly Increased strength and rigidity. The inwardly-directed portions impart a significant increase in the load bearing capabilities of the base and the lid, without the need for complex or expensive materials or constructions.

It is obviously important in a circulating water feature system that the water pumped from the reservoir may return thereto for re-circulation. If it is lost there will need to be a constant input of new water. The present invention allows water from a water feature to fall over a much greater area because the increased structural strength provided by the inwardly-directed portions allows the lid to have a greater radius, whilst still carrying much greater weight. Therefore, the water circulating can fall over a greater area, and still be channelled by the lid back to the reservoir for recirculation.

What is claimed is:

1. A device for use in creating a water feature, the device comprising a base having a bottom wall, and upstanding side walls which together define an open topped non-pressurized liquid reservoir, the side walls defining at least two distinct inwardly-directed portions each of which projects inwardly with respect to the reservoir and defines an upper support surface, the water feature further comprising, a lid for the reservoir which lid locates on the said upper support surfaces of the inwardly-directed portions to be supported thereby, and the lid having an aperture through which liquid contained within the reservoir may be pumped out and subsequently through which the liquid will flow back under gravity into the reservoir.

2. A device as claimed in claim 1, wherein the support surfaces are substantially co-planar with the upper edge of the side wall.

3. A device as claimed in claim 2, wherein the lid is additionally supported by at least a part of the upper edge of the side wall.

4. A device as claimed in claim 2, wherein the support surfaces have marginal regions which support the lid, the support surfaces providing further areas for supporting other parts of a water feature to be constructed on the device.

5. A device as claimed in claim 1, wherein a pump is provided in the base and is adapted to pump liquid from the reservoir.

6. A device as claimed in claim 1, wherein the base is generally circular in plan view.

7. A device as claimed in claim 1, wherein the base has three inwardly-directed portions, which portions are approximately equally distributed around the base.

8. A device as claimed in claim 7, wherein the lid has a peripheral region, a central region, and three outwardly-projecting regions which outwardly-projecting regions, when supported on the base, extend between adjacent inwardly-directed portions of the base.

9. A device as claimed in claim 8, wherein the lid is supported by its peripheral region bearing on the inwardly-directed portions.

10. A device as claimed in claim 8, wherein the central region and outwardly-projecting edge regions of the lid are disposed in a plane lower than that of the peripheral region of the lid.

11. A device as claimed in claim 1, wherein the lid is provided with a plurality of apertures for the through flow of liquid.

12. A device as claimed in claim 1, wherein the lid and base are formed from moulded plastics material.

13. A device as claimed in claim 12, wherein the lid and base are separately formed by vacuum moulding or injection moulding process.

14. A device as claimed in claim 11, wherein the apertures are distributed in a regular pattern over the lid.

* * * * *